US009433951B1

(12) United States Patent
Arnold et al.

(10) Patent No.: US 9,433,951 B1
(45) Date of Patent: Sep. 6, 2016

(54) INFRARED BURNER FOR PRESSURE WASHERS

(71) Applicants: Rick Arnold, Cambridge (CA); Dan Formanek, Cambridge (CA)

(72) Inventors: Rick Arnold, Cambridge (CA); Dan Formanek, Cambridge (CA)

( * ) Notice: Subject to any disclaimer, the term of this patent is extended or adjusted under 35 U.S.C. 154(b) by 0 days.

(21) Appl. No.: 14/946,260

(22) Filed: Nov. 19, 2015

(51) Int. Cl.

| | |
|---|---|
| ***B05B 1/24*** | (2006.01) |
| ***B05B 9/00*** | (2006.01) |
| ***B08B 3/02*** | (2006.01) |
| ***F28D 7/02*** | (2006.01) |
| ***F22B 21/26*** | (2006.01) |

(52) U.S. Cl.
CPC ..... *B05B 1/24* (2013.01); *B05B 9/002* (2013.01); *B08B 3/026* (2013.01); *F22B 21/26* (2013.01); *F28D 7/024* (2013.01)

(58) Field of Classification Search
CPC ..... B05B 1/24; B05B 9/002; B08B 3/02; B08B 3/026
See application file for complete search history.

(56) References Cited

U.S. PATENT DOCUMENTS 3,814,321 A * 6/1974 Mulholland ..... F24H 1/165 222/146.1
5,662,269 A * 9/1997 Francis ..... B08B 3/026 134/107
6,085,739 A * 7/2000 Leiss ..... B08B 3/026 126/350.1
6,435,424 B1 * 8/2002 Pauley ..... B08B 3/026 239/128
8,038,081 B2 * 10/2011 Hendy ..... B08B 3/02 239/127
2011/0081261 A1 * 4/2011 Klika ..... B08B 3/026 417/364
2012/0118335 A1 * 5/2012 Gillingham ..... B05B 9/002 134/105

* cited by examiner

*Primary Examiner* — Ryan Reis
(74) *Attorney, Agent, or Firm* — Nasser Ashgriz; UIPatent Inc.

(57) ABSTRACT

A pressure washer with an infrared burner for generating hot water is provided. The washer comprises of: an upright cylindrical shell having a flue on the top and being open at the bottom, and having furnace type insulations as lining on its inner and outer walls; a coil type heat exchanged fitted inside said shell, said heat exchanger having a cold liquid input and a hot liquid output; an upright porous-cylinder inserted into said heat exchanger, said porous-cylinder having a closed top, an open bottom, an inner surface area, an outer surface area, and a cylinder volume being the volume inside said cylinder; a perforated sleeve tightly fitted into said porous cylinder covering all the inner surface area of said porous-cylinder; an air-fuel mixing chamber to generate an air-fuel mixture; an injection system to inject said air-fuel mixture into said cylinder volume; a perforated plate at the bottom of the cylinder to distribute the air-fuel mixture into the volume; an ignition means located close to the outer surface of said porous cylinder; whereby a uniform infrared radiating flame is form all over the porous cylinder, thereby uniformly heating the liquid flowing through said coil.

15 Claims, 6 Drawing Sheets

INFRARED BURNER FOR PRESSURE WASHERS

FIELD OF THE INVENTION

The present invention relates in general to pressure cleaning systems, and in particular to an improved continuous flow water heating-pressure washing systems with an infrared burner.

BACKGROUND OF THE INVENTION

Hot water pressure washers have numerous applications in the industry, such as in cleaning the inside of ovens and furnaces. Hot water applied at a high pressure on a surface is known to have superior cleaning advantages. Hot water pressure washers first use a water pump to generate a continuous flow of high pressure cold water. The high pressure cold water is then passed through a heat exchanger, usually a coil type heat exchanger, to generate a continuous flow of high pressure hot water. The hot water is then taken to a hand held trigger gun and nozzle of a wand to guide the water on a surface for cleaning.

The prior art uses flame combustion to produce the heat required to heat water for use in hot pressure washing equipment. This technology has limitations due to low heat transfer efficiency and high carbon monoxide emissions. These devices also generate corrosive condensates. The use of natural gas, propane or butane gases in these systems produce corrosive condensates when the flue gasses cool past their dew point—the water vapor produced by combustion condensates in the presence of carbon dioxide produces carbonic acids. These acids can corrode metals and cause premature appliance and component failure.

The prior art devices that use flame ball to heat the water have an open bottom burner. The combustion gases rise up the outer area of the flame envelope causing a cooling effect on the lower part of the water heating coil. This restricts the amount of heat that is transferred to the lower part of the coil, which is the coolest due to the incoming water entering the lower end of the coil. The only way to get the heat to transfer to this area of the coil is by scrubbing the flue gasses to the side of the water heating coil. This scrubbing is greatly reduced by the up flow of cool rising air from below the coil entering the flame envelope.

The burners in the prior art devices comprises of numerous individual burner nozzles injecting fuel inside a combustion chamber. The air needed to burn the fuel enters from the surrounding through open bottom design of these burners. The fuel nozzles are generally aimed at the water coils for scrubbing purposes to produce heat transfer to the coil. The turbulence caused by burners passing over and through each other tends to create excessive amounts of carbon monoxide, CO. Many Countries have limitations on the amount of CO produced by gas burning appliances. The current fix is to de-rate the burner and fire it at a less BTU heat output to lower emissions; unfortunately this also reduces the heat output.

The present invention introduces application of an infrared burner to heat the water in hot water washers. This device greatly increases heat transfer of these burners, especially, at the lower parts of the heat exchanger, close to the cold water inlet. The additional heat transfer virtually eliminates the problematic condensation of flue gasses on the lower part of the coil which produce corrosive carbonic acids that destroy steel and cast iron.

SUMMARY OF THE INVENTION

An infrared burner for application of hot water washers is provided. Infrared burners transfer a large amount of heat through radiation. This is a much more efficient transfer of thermal energy for rapid heating and compact devices. The present invention provides an infrared burner with a controlled flow of both air and fuel to produce an almost stoichiometric combustion with very low emission of CO and unburned hydrocarbons. The device is so designed to distribute the heat very uniformly through a coil type heat exchange that carries water. Thereby, the water heated rapidly and efficiently, generating hot water with minimal fuel consumption.

Flame burners and infrared burners of equal BTU consumption rates will produce equal amounts of heat. The difference in performance of the 2 burners is the way the heat is transferred. Flame burners will transfer heat most through conduction, direct contact of hot flue gasses to the wall of the heat exchanger. Infrared burners transfer large amounts of heat through radiation as well as having the equal amount of hot combustion gasses to transfer heat through conduction. By utilizing the double heat transfer properties of the infrared burner higher levels of efficiency can be achieved which may allow the manufacture of these appliances to use less fuel to achieve the same outcome as well as lower emissions. In addition, the additional heat transfer virtually eliminates the problematic condensation of flue gasses on the lower part of the coil which produce corrosive carbonic acids that destroy steel and cast iron. During testing there were no condensates present on the coil. In order for combustion from gas flame burners to transfer heat, the hot gasses must be scrubbed against the walls of the heat exchange unit. Gasses not in direct contact with the heat exchanger have little infrared heat transfer, therefore, they are a waste of energy. This waste of energy results in higher stack temperatures requiring the use of more expensive, high insulation value vent materials.

By using a surface combustion infrared burner design the emissions are reduced to near or at zero as all the fuel burns on the surface of the burner and not away from the burner. This allows the burner surface to be located closer to the water heating coil. Heat transfer is now by both radiation and conduction whereas with the flame style burner heat transfer is very little radiation and mostly conduction, the scrubbing of the flue gasses against the cold water coil.

Infra-red burners have a cooler combustion temperature than flame style burners. The cooler temperatures as well as the control of excess air entering the flame envelope greatly reduce the production of Oxides of Nitrogen, NOx. The global move in the gas industry is to reduce NOx emissions. These emissions appear when air is heated above 2000° F. in the presence of nitrogen. The use of infra-red burners will reduce the NOx emissions of the pressure washing industry globally.

Prior devices must have nozzles changed and gas pressure changed to increase or reduce the firing rate. This could mean changing up to 66 burner nozzles and a gas regulator or gas valve assembly. In the new infra-red burner system the air gas zero governors maintain the air/fuel ratio with air blower speed increases or decreases. This system allows the firing rate to change without changing any parts, only a switch adjustment within the blower control board. Firing rates from 25% to 100% can be done by the switch adjustment. Changing firing rate can be done in less than 1 minute is comparison to 1 to 2 hours on existing flame burner systems.

On high altitude equipment, above 2000 feet above sea level burner must be de-rated to function properly. On prior devices this meant burner nozzle and pressure changes. On the infra-red system the high altitude de-rating can be done by the speed switch on the blower control board, which saves considerable time and requires no part changes.

Some large industrial washing applications require the installation of more than one washing wand. When the second wand is opened and the water flow increased the firing rate must also increase to maintain the desired temperature. On prior systems the activation of the second wand would trip a switch to increase the gas pressure on a 2 stage valve. The increase of gas pressure to an atmospheric burner nozzle will not track properly the air/fuel ratio which leads to excessive Carbon Monoxide production. On the infra-red burner the signal that the second wand has opened drives the blower speed up via the blower control board and the zero governor gas control valve delivers the correct fuel increase to maintain the correct air/fuel ratio. This eliminates the increase of Carbon Monoxide and controlling the CO levels within Government regulations.

The objects of the present invention are as follows:

One object of the present invention is to provide a continuous high pressure hot washer with greater levels of heat transfer and a rapid initial heating of the cold water.

Another object of the present invention is to provide a continuous high pressure water heater with low carbon monoxide emissions.

Another object of the present invention is to provide a burner to reduce NOx emissions.

Another object of the present invention is to provide a burner with low maintenance.

Another object of the present invention is to provide a burner with eliminating large number of parts, which save in service stock and energy.

Another object of the present invention is to provide a burner that reduces in manufacture assembly time by reduction of number of parts required during assembly.

Another object of the present invention is to provide a burner that can be easily converted from burning natural gas to propane gas, and oil burners to gas burners. The prior art is very dependent on the fuel type with changing combustion characteristics with temperature and humidity.

Another object of the present invention is to reduce the number of various size pressure rating and designated gasses (natural gas, propane and butane gas) valves and nozzles required for service stock and conversion of appliance to other gasses.

Another object of the present invention is to have a low stack temperature. The prior art with high stack temperatures requires costly high temperature vent material.

Another object of the present invention is to provide a stable initial firing with repeatability. The firing of the current burners for this purpose is erratic and unstable.

Another object of the present invention is to have a fully controlled air inlet system which allows filtering of incoming air reducing burner contaminants. The current devices have natural draft venting, which makes it very susceptible to building negative pressures.

Another object of the present invention is to allow for direct piping of air inlet to burner to the outdoors eliminating the use of air from within the building reducing building air infiltration from outdoors reducing the buildings annual heat costs as well as reduction of airborne contaminants to burner from any manufacturing processes present. This option is not available on present designed atmospheric flame burners.

Other objects, features, and advantages of the present invention will be readily appreciated from the following description. The description makes reference to the accompanying drawings, which are provided for illustration of the preferred embodiment. However, such embodiments do not represent the full scope of the invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
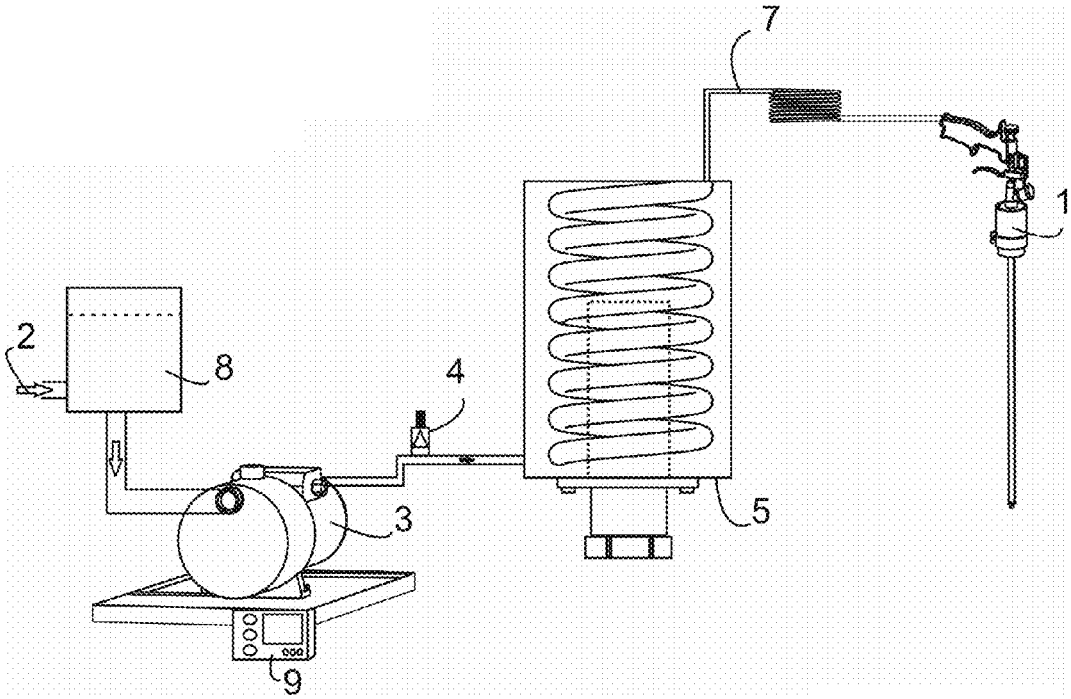
FIG. 1 shows a perspective view of a hot pressure washer system.

FIG. 1 shows the main elements of a hot water pressure washer. The hot water pressure washer comprises of a spray gun 1, a water inlet assembly 2, a pump 3, a valve assembly 4, a heat exchanger assembly 5, a water outlet assembly 7, a water tank 8, and a control system 9. The pressure washer pump 3 receives a low pressure cold water from a water tank 8 and outputs a flow of high pressure hot water through the spray gun 1 so that the users of the present invention can clean a variety of surfaces.

FIGS. 2-6 show the heat exchanger assembly 5 with an infrared burner for generating hot water. The heat exchanger assembly 5 comprises of an upright cylindrical shell 20 having a flue 21 on the top and having a bottom plate 22. The shell height depends on the pressure washer size and flow rate. In one embodiment of the present invention, the shell height is in the range of 20 to 25 inches. The shell 20 is installed and secured on the bottom plate 22. The bottom plate 22 has an opening 25 to let air and fuel mixture enter the system. Insulations 27 are provided on the outer walls of the shell 20. Although, the embodiment described here provides an upright cylindrical heat exchanger assembly, heat exchangers with other configurations can also be designed.

Again as shown in FIGS. 2-6, a coil type heat exchanger 30 is fitted inside said shell 20. Cold water 31 enters the heat exchanger coil 30 at inlet 32 and hot water 33 exits the heat exchanger coil 30 at outlet 34. The coil starts from the bottom of the heat exchanger 32 and goes around the inner surfaces of the shell up to more than half the height of the shell 20. The number of circular coils increased on the upper part of the heat exchanger, such the lower part of the heat exchanger has an open space, whereas the upper part of the heat exchange is filled with heat exchanger coils. The size and the number of coils and the ratio of the lower open space to the upper filled space with heat exchanger coils is determined based on the size and the heating power of the heat exchanger. In the present embodiment, a ½ inch coil is used as the heat exchanger. In addition, although, the embodiment described here provides a coil type of heat exchanger, other types of heat exchangers, such as straight wall pipe type, can also be used.

Figure 2:
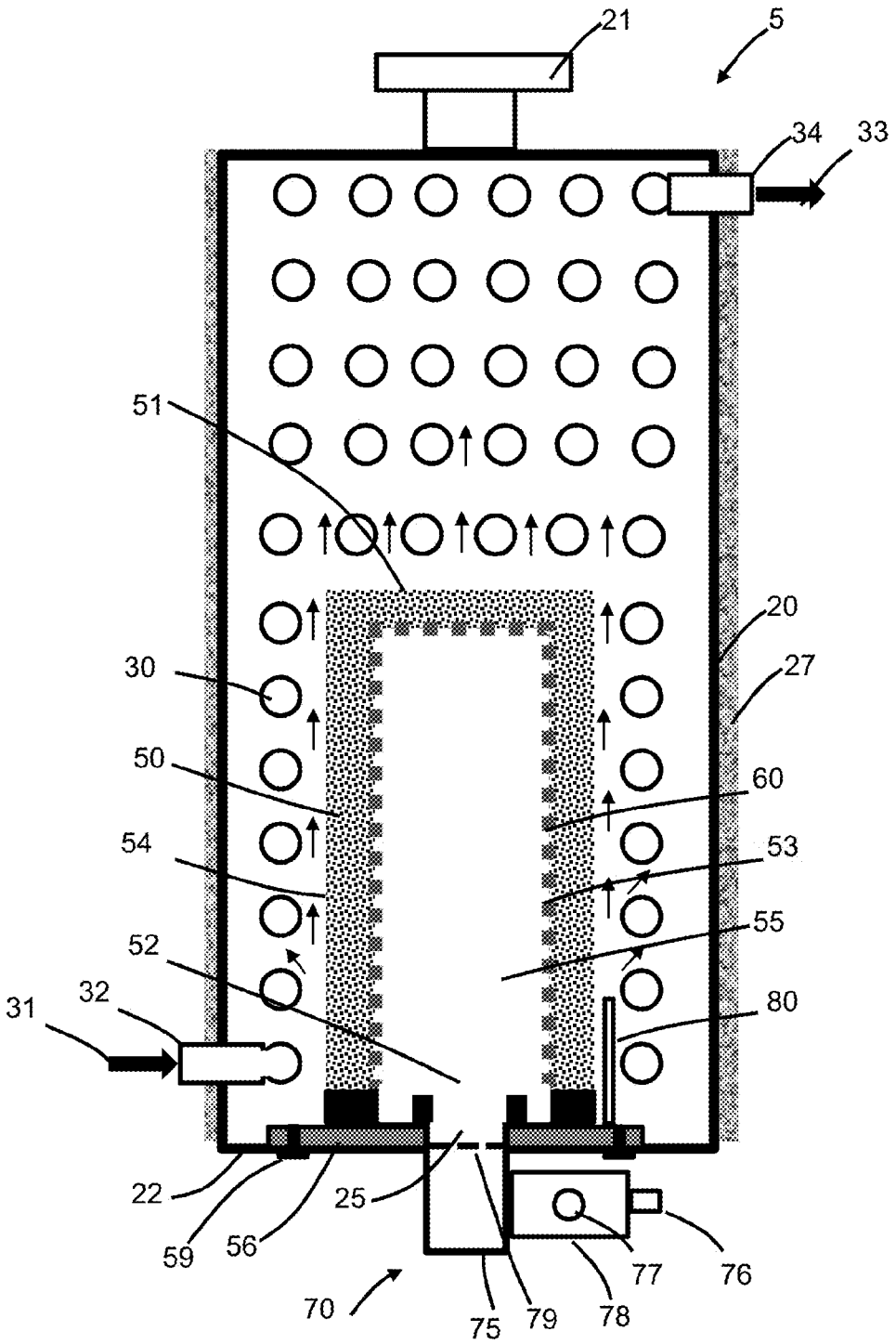
FIG. 2 shows a cross sectional view of the heater of the present invention.
Figure 3:
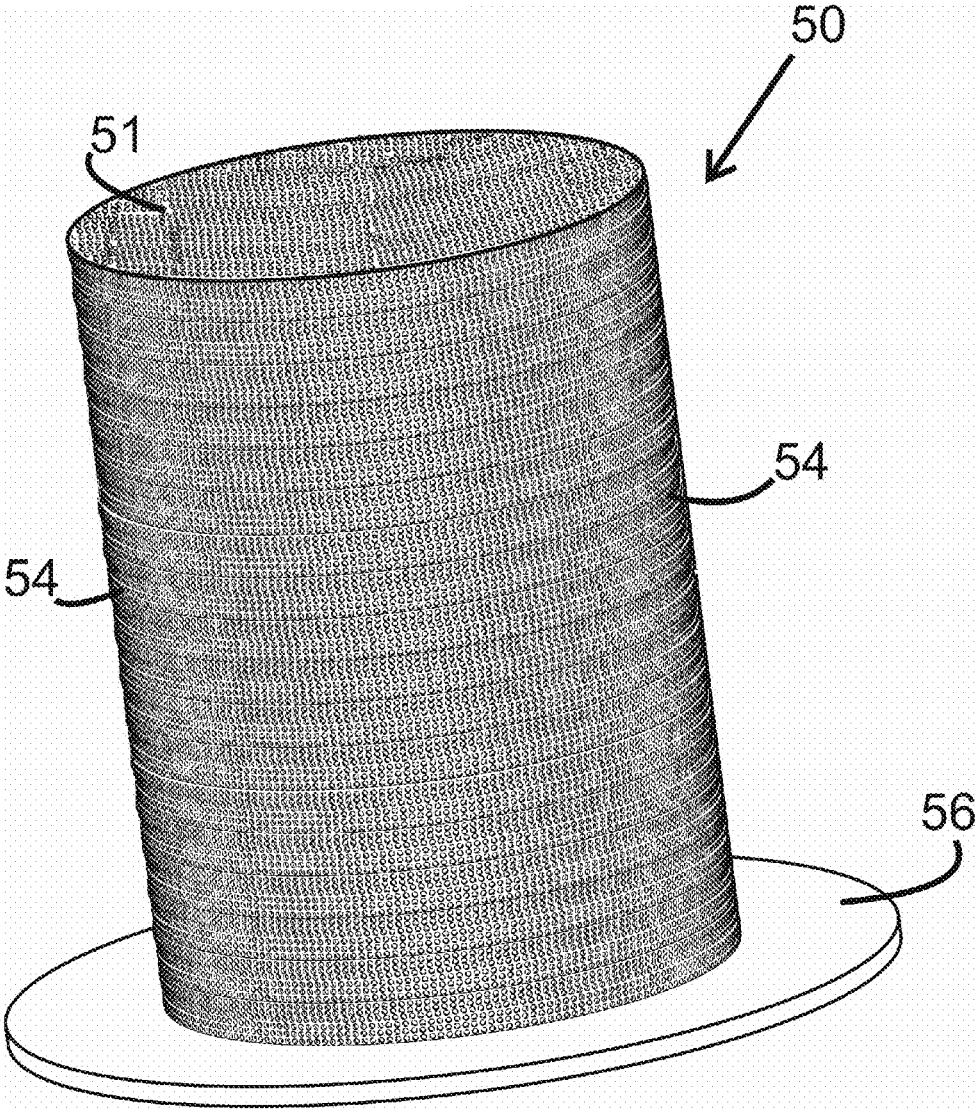
FIG. 3 shows a perspective view of the infrared burner of the present invention.
Figure 4:
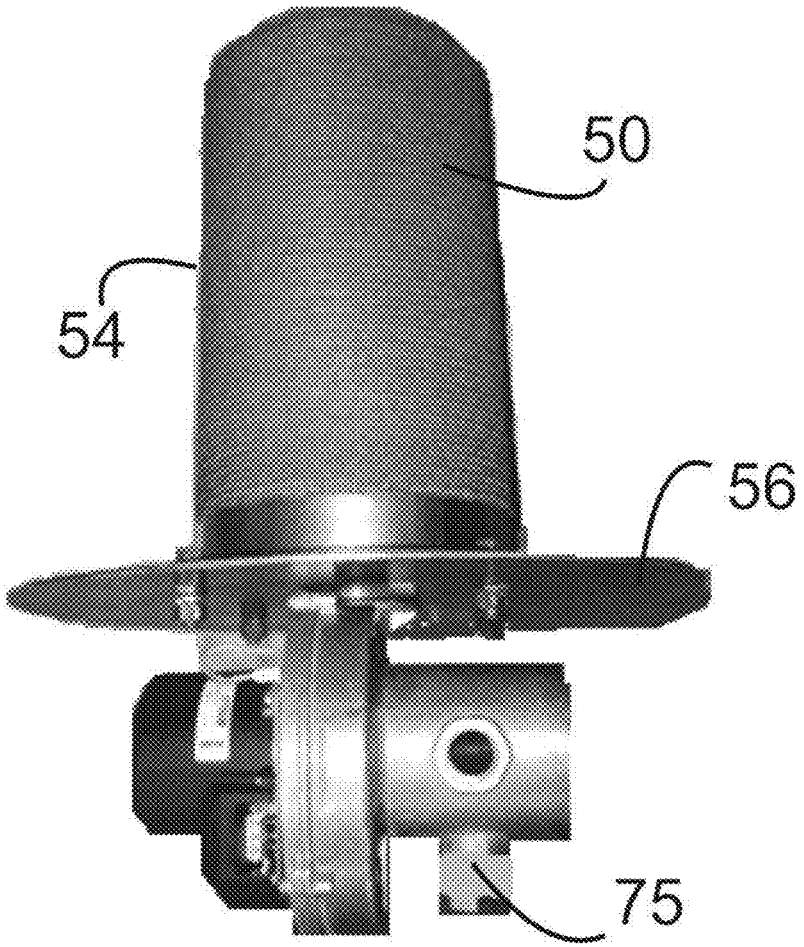
FIG. 4 shows a perspective view of the infrared burner of the present invention.

Again as shown in FIGS. 2-4, an infrared burner assembly is inserted into the open space in the lower part of the heat exchanger 30. The infrared burner assembly comprises of a perforated rigid frame 60 and porous cover 50. The burner height can be about 14 inches, having about 6-12 inches of coils above it. The porous cover 50 is preferably made of stainless steel woven mesh. This material can be wrapped around a stainless steel frame 60 with pores to allow the pre-mixed air and fuel to permeate the mesh and burn evenly on the surface of the burner. The rigid perforated frame 60 is so designed to allow for a uniform flow of gas through all surfaces of the perforated frame. The gas intends to flow at the lower parts, therefore, the holes and the slits on the lower part of the frame are different than those on the upper part. This allows that the flow become uniform through the whole mesh. Having a very uniform flow though the mesh is important to have a uniform air flow distribution, and therefore, a uniform temperature on the outer surfaces of the burner.

In the preferred embodiment of the present device, the burner assembly is cylindrical, having porous cylindrical walls and a porous top 51, but an open bottom 52. The burner assembly has an inner surface area 53, an outer surface area 54, and a cylinder volume 55 being the volume inside said cylinder 50. The porous top is an important element of the present burner to provide sufficient heat to the water coils or pipes directly at the top portion of the heat exchanger.

An important design of the present burner is its flat top. Because of its cylindrical body, the hot combustion gases flow through its cylindrical surface and move upward heating the heat exchanger coils or tubes. Therefore, the heat exchanger tubes are heated by infrared heating, as well as by having hot gases passing through them. In order to produce sufficient energy to rapidly heat the flowing water, a relatively large burner is needed. Therefore, the diameter of the cylindrical burner is relatively large. Since the burner is located inside the heat exchanger coil a portion of the coils are located on the top of the burner. By having a flat porous top, the burner produces bot infrared heating and hot gases towards the coils located directly on the top of the burner. Without a porous top, a dead flow zone may occur on the top of the burner, reducing burner heating efficiency.

Again as shown in FIGS. 2-6, the burner has a skirt 56 having apertures. The skirt of the burner is attached (preferably bolted 59) to the bottom plate. The skirt is sandwiched between the two ¼" thick clamp rings. This gives the assembly a lot of strength to avoid leaking the air/fuel mixture from between the mounting surface between the burner and the main mounting plate. The clamp ring is only used to add strength and rigidity to clamp the burner down evenly. Other options for production could be to make the burner with a thick base and eliminate the need for the clamp ring. Note the second ¼" thick burner clamp ring is welded to the 10 gauge thick base plate. Once the burner is clamped between these two rings, a total of approximately ⅝" thick zone is formed under the burner which does not have porous surface. A steel ring laser cut from ¼" plate is used between the burner base and the main mounting plate. An identical ring of ¼" plate is welded to the main mounting plate to add rigidity to the entire unit to ensure a good gas tight seal.

A gasket is cut from high temperature gasket material. Various materials can be specified for manufacture. One advantage of having the lower non porous zone under the burner is to allow for a potential water leak in the coil and not have the water leak into the blower causing damage. Water intrusion from condensate forming on a cold coil seemed to be eliminated by the infrared burner as none was observed to be formed during testing.

Figure 5:
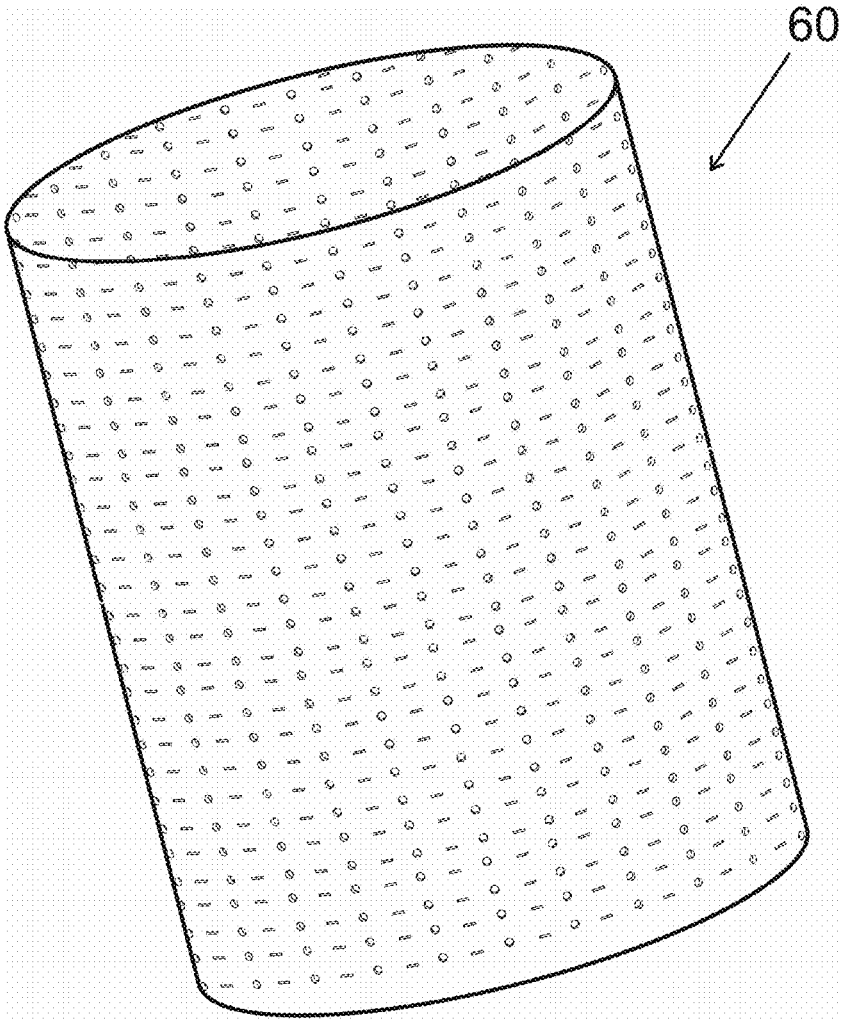
FIG. 5 shows a perspective view of the perforated sleeve of the present invention.
Figure 6:
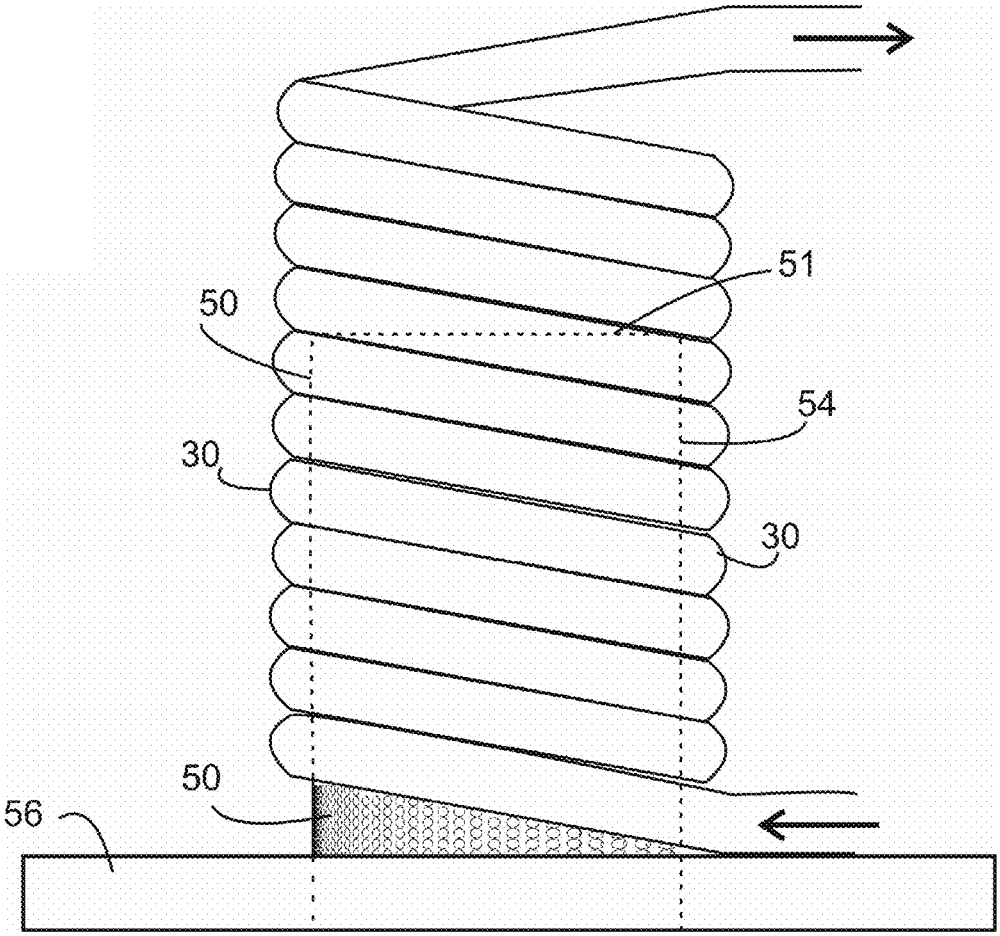
FIG. 6 shows a front view of the heat exchanger coil of the present invention.

In the preferred embodiment, the burner is constructed by manufacturing a perforated rigid frame 60 to a desired shape and size. Then a porous noncombustible material, such a porous stainless steel, is wrapped around the frame and welded together for tight fit. Different pieces of the same porous material are cut to size and fit to the top part of the frame to make a porous surface all over the frame. FIG. 5 shows the inside of the burner showing the frame 60 used to allow the air/fuel mixture to permeate through the mesh on the outside. This disperses the gasses across a very large surface so as to keep the combustion on the burner surface eliminating long flames and flame impingement. The hole distribution on the frame 60 is so designed to have a uniform flow of gas throughout its outer surface.

Again as shown in FIGS. 2-6, an air-fuel injection assembly 70 is attached to the bottom plate 22 to mix and inject air and fuel into the burner. Air is provided to the chamber 52 through a blower 75. The blower sucks air in from an air inlet ort 76 and fuel from an fuel inlet port 77. Air and fuel are mixed inside a chamber 78 before they are injected into the chamber by the blower. A perforated plate 79 may be placed between the mixing chamber 70 and the opening of the bottom plater 25 to better distribute the air-fuel mixture into the volume. A blower mounting plate, preferably made by laser cutting a ¼" plate, is welded in the middle of the bottom plate 22 to give a solid mounting area for the blower to mount and seal. A gasket is used in between the blower and this main mounting plate. Electrical connections on the blower motor is a plug in molex connector for quick attachment.

A spark ignition 80 is installed close to the outer surface of the porous cylinder 50. The ignition source is located about ¼ inch from the surface of the porous burner. At this spacing, a spark will form between the ignition source and the burner by using about 12-16 kvolts of electricity. The height of the spark rod is also very important. If the spark location is too low, there will be a delay in ignition. Other types of ignition sources, such a glow plug can be used instead. The ignite/flame rod 80 is removed from the bottom of the main bottom plate. This allows for fast servicing and changing of the flame rod. It takes less than 2 minutes to change it out making service calls much faster. The prior art pilot mounted flame rod is very hard to access and required the removal of the main burner in most cases.

The spark source 80 also acts as a flame detector. It can detect if the flame is out, and if so, apply the spark to reignite the flame.

In operation, the air fuel mixture enters into the inner volume 55 of the porous cylinder 50. The perforated sleeve 60 requires a pressure drop across it, thereby results in the gases entering the volume to reach to certain uniform pressure before being able to pass through the holes and slits on the plate. This causes that the gas flow through the porous cylinder becomes very uniform. Once a uniform flow of air-fuel mixture exits the porous cylinder, the mixture is exited at one point using a spark ignitor. A glow plug can also be use. As soon as the mixture is ignited a flame is established on the whole outer surface of the burner.

This type of flame has high infrared radiation, and therefore, the burner of this type is referred to as an infrared burner. The gasses combust on the hot burner surface and virtually eliminate any combustion flame within an inch or so of the burner. This allows the burner to be located close to the coil. The spacing between the burner surface and the heat exchanger coils is usually kept small.

In one embodiment of the present device the spacing between the burner and the coil is 4 inches throughout. The spacing between the coils and the burner should be in the range of 2-6 inches. The proper spacing is determined based on optimizing the heat transfer and emission. The closer the burner to the coils, the better the heat transfer. However, when the burner is too close to the coils, there will be direct impingement of the flame on the coils, which results in the CO production and increased CO emission from the burner. Therefore, an optimum distance need to be determined for optimum heat transfer and minimum emission. In the preferred embodiment of the present device, this distance is between 2-6 inches.

Since the entire burner surface radiates heat, there will be even heat transfer to the water coil. In the prior art flame style burner the coldest part of the water coil is the lower part of the coil. Testing with the infrared burner showed this area was being heated much better and was operating at a higher temperature. This eliminated the corrosive condensate from forming on the coil.

Using an infrared burner heats the entire coil with the same intensity which would cause less stress on the coil in the areas normally impinged by a flame style burner. This should in turn increase the life if the coil due to fatigue failure from direct flame impingement. Infrared burners burn the fuel on the surface of the burner so only heat and not flame would transfer to the coil surface.

The steel cap at the very top of the coil forces the hot flue gasses around the many turns of steel pipe forming the coil as to increase heat transfer and not just let the hot gasses go straight up the flue.

Tests with the present infrared burner showed that it got to a full operating temperature faster than the prior art burners with the same BRU ratings. In addition, its outlet water temperature was higher than the comparable flame burners, even though its gas consumption efficiency was lower.

Ignition of the present infrared burner is very smooth. Whereas, atmospheric air gas burners suffers from excessive oxygen consumption and turbulence that snuff out the pilot, and cause the "flame safeguard" to turn the spark back on and relight the pilot immediately, all while the main burner struggles to establish a stable burn. In the flame burners, the massive expansion of burning gasses without flow direction and structure results in a poor but rapid outward burst of flame.

The infrared burner of the present device has a much lower vent stack temperatures—30% on the infrared burner even though the burner firing rate is only 5% lower than the prior art burner, with water heating up almost 300% faster than the prior art burner. This gives a clear indication of the efficiencies gained over the atmospheric burner. The lower stack temperature of 338° F. will allow installation of much cheaper B vent or L vent material over the very expensive A vent material presently required by the prior art. The B vents are rated to 470° F. and L vent is rated to 570° F., whereas, the A vent is rated to 1000° F. The actual vent required for use would be dictated by the local and applicable codes enforced by local authorities having jurisdiction. The present device is not restricted to any one particular vent material.

Overall the infrared burner outperforms the prior art atmospheric burner in all areas of repeatable safe reliable main burner ignition, carbon monoxide reduction, NOx reduction, consistent air/fuel mixtures with respect to varying temperature and humidity changes. heat transfer resulting in higher efficiencies and lower fuel costs. The water heating up 3 times faster would over the life of the appliance save countless gallons of water being wasted waiting for the unit to heat up. Generally, the infrared burner is a much better approach to the efficient use of energy over the atmospheric air gas burners of the prior art.

The followings are the advantages of the present infrared burner over the prior art direct combustion burners for hot water washers:

- Heats up 300% faster;
- carbon monoxide levels reduced from over 3000 PPM to less than 15 PPM to meet EPA and TSSA/CSA standards of EPA less than 400 PPM and TSSA/CSA less than 100 PPM;
- Burner maintenance is lower since high surface temperatures burn off air born contaminants;
- Controlled air inlet allows use of air filtration to reduces burner particulate contaminants and possible addition emission when burning these contaminants.
- No conversion of Zero Governor gas valve required and only 1 component in mixer required switching gasses compared to changing up to 66 nozzles on flame type ring burners. Huge global reduction of parts production, shipping and stocking.
- Temperature and humidity have negligible impact on surface combustion infrared burners.
- Stack temperatures reduce; allowing use of inexpensive B or L vent material opposed to very expensive A vent now required by current stack temperatures.
- Main burner fires clean and smooth with full carryover in approximately 1 second with stable repeatability.
- Power burner designs tend not to be effected by building negative pressure compared to atmospheric burners reducing the possibility of CO poisoning of workers in building due to flue gas spillage.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A pressure washer with an infrared burner for generating hot water comprising:

a. a shell having a closed top with a vent, an open bottom, and side walls with inner and outer surfaces;

b. a heat exchanger fitted inside said shell, said heat exchanger having a cold liquid inlet port and a hot liquid outlet port, and wherein said heat exchanger has an open inner space;

c. a perforated rigid frame inserted into said open inner space of said heat exchanger, said perforated rigid frame is designed to provide a uniform flow of a gas through all its perforated surface, said perforated rigid frame having an open bottom, an inner surface area, an outer surface area, and an inner volume;

d. a porous burner being a porous cover wrapped around said perforated rigid frame, wherein the outer surfaces of said porous burner are at a predefined distance with said heat exchanger, whereby said distance is determined by the BTU size of said infrared burner, size of said heat exchanger and experimental trials to obtain the lowest combustion emissions;

e. a bottom plate sealably attached to the bottom of said perforated rigid frame, thereby forming a closed volume inside said porous burner, said bottom plate being large enough to also receive said bottom of said shell;

f. an air-fuel supply system attached to said bottom plate to supply an air-fuel mixture into said inner volume;

g. an ignitor located close to the outer surface of said porous burner to ignite said gas that permeate through the porous burner forming an infrared radiating flame all over the porous burner, thereby uniformly heating the liquid flowing through said heat exchanger, and whereby said pressure washer produces hot water with a high heat exchanger efficiency and low combustion emissions and pollution by both infrared radiation and by having hot air go through said heat exchanger coil.

2. The pressure washer of claim 1, wherein said shell and said porous burner are cylindrical.

3. The pressure washer of claim 1, further having insulation material as lining on the outer walls of said shell.

4. The pressure washer of claim 1, wherein said heat exchanger is a coil type heat exchanger.

5. The pressure washer of claim 1, wherein said predefined distance is between 2-6 inches and preferably about 4 inches.

6. The pressure washer of claim 1, wherein said porous burner is made of any one of stainless steel woven mesh or ceramic.

7. The pressure washer of claim 1, wherein said pressure washer has a liquid trap to collect any condensate and prevent it from entering into the porous burner.

8. The pressure washer of claim 1, wherein said ignitor is any one of spark ignitor or glow plug.

9. The pressure washer of claim 1, wherein said ignitor is inserted through an opening at the bottom plate to locate the ignitor close to the lower parts of the porous burner.

10. The pressure washer of claim 1, wherein said vent is a B vent rated for emission temperatures of less than 470° F.

11. The pressure washer of claim 1, wherein said vent is a L vent rated for emission temperatures of less than 570° F.

12. The pressure washer of claim 1, wherein said fuel being any one of natural gas or propane.

13. The pressure washer of claim 1, wherein said ignitor has means to provide a flame as a flame safeguard circuit.

14. The pressure washer of claim 1, further having a perforated plate attached to the bottom plate to uniformly distribute the air-fuel mixture into said inner volume.

15. The pressure washer of claim 1, wherein said air-fuel supply system comprises a fan attached to a cylindrical mixing chamber having a cylindrical body, wherein said cylindrical mixing chamber has an air inlet port on an axial plane and a fuel inlet port on said cylindrical body, whereby said fan sucks air from the ambient while mixing it with radially introduced fuel to provide good mixing between air and fuel before injection into said porous burner.

* * * * *